US012116882B2

(12) United States Patent
AlSultan et al.

(10) Patent No.: US 12,116,882 B2
(45) Date of Patent: Oct. 15, 2024

(54) PRODUCTION LOGGING TOOL FOR WELLS WITH DEBRIS AND VISCID MATERIAL

(71) Applicant: SAUDI ARABIAN OIL COMPANY, Dhahran (SA)

(72) Inventors: Fuad A. AlSultan, Alahsa (SA); Muslim Al-Hassan, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/183,732

(22) Filed: Mar. 14, 2023

(65) Prior Publication Data

US 2024/0309750 A1 Sep. 19, 2024

(51) Int. Cl.
*E21B 47/017* (2012.01)
*E21B 47/00* (2012.01)

(52) U.S. Cl.
CPC ..... *E21B 47/017* (2020.05); *E21B 47/006* (2020.05)

(58) Field of Classification Search
CPC ..... E21B 47/017
See application file for complete search history.

(56) References Cited

U.S. PATENT DOCUMENTS

| | | | |
|---|---|---|---|
| 9,416,643 B2 | 8/2016 | Purkis et al. | |
| 9,528,369 B2 | 12/2016 | Brown | |
| 9,915,144 B2 | 3/2018 | Manzar et al. | |
| 10,294,771 B2 | 5/2019 | Donzier et al. | |
| 11,035,229 B2 | 6/2021 | Castillo | |
| 11,319,802 B2 | 5/2022 | Andreychuk et al. | |
| 11,352,839 B2 | 6/2022 | Donzier et al. | |
| 11,448,059 B2 | 9/2022 | Rueda et al. | |
| 2016/0018554 A1* | 1/2016 | Vigneaux | G01V 3/30 250/262 |
| 2019/0153852 A1* | 5/2019 | Lallemand | E21B 47/12 |
| 2020/0109974 A1* | 4/2020 | Hill, III | G01N 11/08 |
| 2022/0228447 A1 | 7/2022 | Donzier et al. | |

FOREIGN PATENT DOCUMENTS

CN 109209357 B 2/2022

OTHER PUBLICATIONS

N. Benlakhdar et al.; "Integrating Pulse Neutron Measurements with Array Production Logging for Enhanced Production Characterization in Horizontal Wells", SPE-192219-MS; Society of Petroleum Engineers; Apr. 2018; pp. 1-11 (11 pages).

(Continued)

*Primary Examiner* — Giovanna Wright
(74) *Attorney, Agent, or Firm* — Osha Bergman Watanabe & Burton LLP

(57) ABSTRACT

A method for logging a well that includes providing a production logging tool (PLT) with at least one sensor which is covered by a protective sleeve. The method includes deploying the PLT from a logging unit at a surface location of a wellsite into a wellbore of the well. The method includes the PLT receiving a command to acquire well data of a flowstream in the wellbore of the well to form a well log. The method includes acquiring the well data of the flowstream using the PLT, determining that the sensor is contaminated based on the acquired well data, performing a cleaning cycle to clean the sensor using the protective sleeve, then transmitting the well data to the logging unit.

20 Claims, 9 Drawing Sheets

(56) References Cited

OTHER PUBLICATIONS

K. AlSunnary et al.; "Innovative Production Logging Solution Enabled Comprehensive Horizontal Well Evaluation in Challenging Downhole Conditions", SPE-196241-MS; Society of Petroleum Engineers; Oct. 2019; pp. 1-18 (18 pages).
"Cased Hole Logging: Multiphase Array Production Logging Tool", Dec. 5, 2020; pp. 1-2; Retrieved from the Internet: URL: https://www.sparteksystems.com/siteimages/Brochures/Flyer_Multi_Phase_Array_Production_Logging_Tool.pdf (2 pages).
O. M. Chira et al.; "Production logs in horizontal wells-case study of a developed field", Ingenieria Petrolera; vol. 57; No. 5; Sep. 2017; pp. 364-376 (13 pages).
W. Song et al.; "Design and Implementation of the Array Logging Tool on Horizontal Production Logging", Hindawi, Mathematical Problems in Engineering; vol. 2020; No. 6903970; Dec. 1, 2020; pp. 1-7 (7 pages).
Lulu Liao; "Interpretation of Array Production Logging Measurements in Horizontal Wells for Flow Profile", Texas A&M University; Masters Thesis: Master of Science, Petroleum Engineering; Dec. 2013; pp. 1-100 (100 pages).

* cited by examiner

PRODUCTION LOGGING TOOL FOR WELLS WITH DEBRIS AND VISCID MATERIAL

BACKGROUND

Various oil and gas wells use tubular elements as components of the wellbore. The production may include water, oil, and/or gas constituents in more than one phase combined in a flowstream through the tubular elements. Instruments may be used to monitor operating parameters such as quantifying the constituents of the multiphase flow. An example instrument is a multiphase array production logging tool, hereafter PLT. The PLT may include sensors arranged on the outside of the PLT to expose the sensors to the flowstream. The PLT may measure, for example, capacitance, resistivity, acoustic density, velocity, and temperature to determine water holdup, gas holdup, and flowrate. The instrument may become contaminated by the flowstream constituents, which can adversely affect the measurement capabilities. Removing the PLT from the flowstream is typically necessary to refresh the sensors. Removing the PLT is a time consuming and resource intensive process. Accordingly, there exists a need for having the ability to clean or refresh the sensors of the PLT without removing the PLT from the flowstream.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, a method for logging a well that includes providing a production logging tool (PLT) with at least one sensor which is covered by a protective sleeve. The method includes deploying the PLT from a logging unit at a surface location of a wellsite into a wellbore of the well. The method includes the PLT receiving a command to acquire well data of a flowstream in the wellbore of the well to form a well log. The method includes acquiring the well data of the flowstream using the PLT, determining that the sensor is contaminated based on the acquired well data, performing a cleaning cycle to clean the sensor using the protective sleeve, then transmitting the well data to the logging unit.

This disclosure presents, in accordance with one or more embodiments, a system for logging a wellbore of a well. The system includes a logging unit at a surface location of a wellsite, a production logging tool (PLT) with an upper part, a logging tool axis, and a lower part located on the axis. The PLT includes a body actuator coupled to the upper part and lower part that translates the upper part and the lower part along the axis. The PLT also has a moveable sensor mount. The mount is coupled at a strip first end to the PLT upper part and coupled at a strip second end to the PLT lower part. A sensor is mounted on the moveable sensor mount. The sensor acquires well data of a flowstream in the wellbore of the well to form a well log. The PLT includes a protective sleeve with a sleeve inner surface that covers the sensor.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
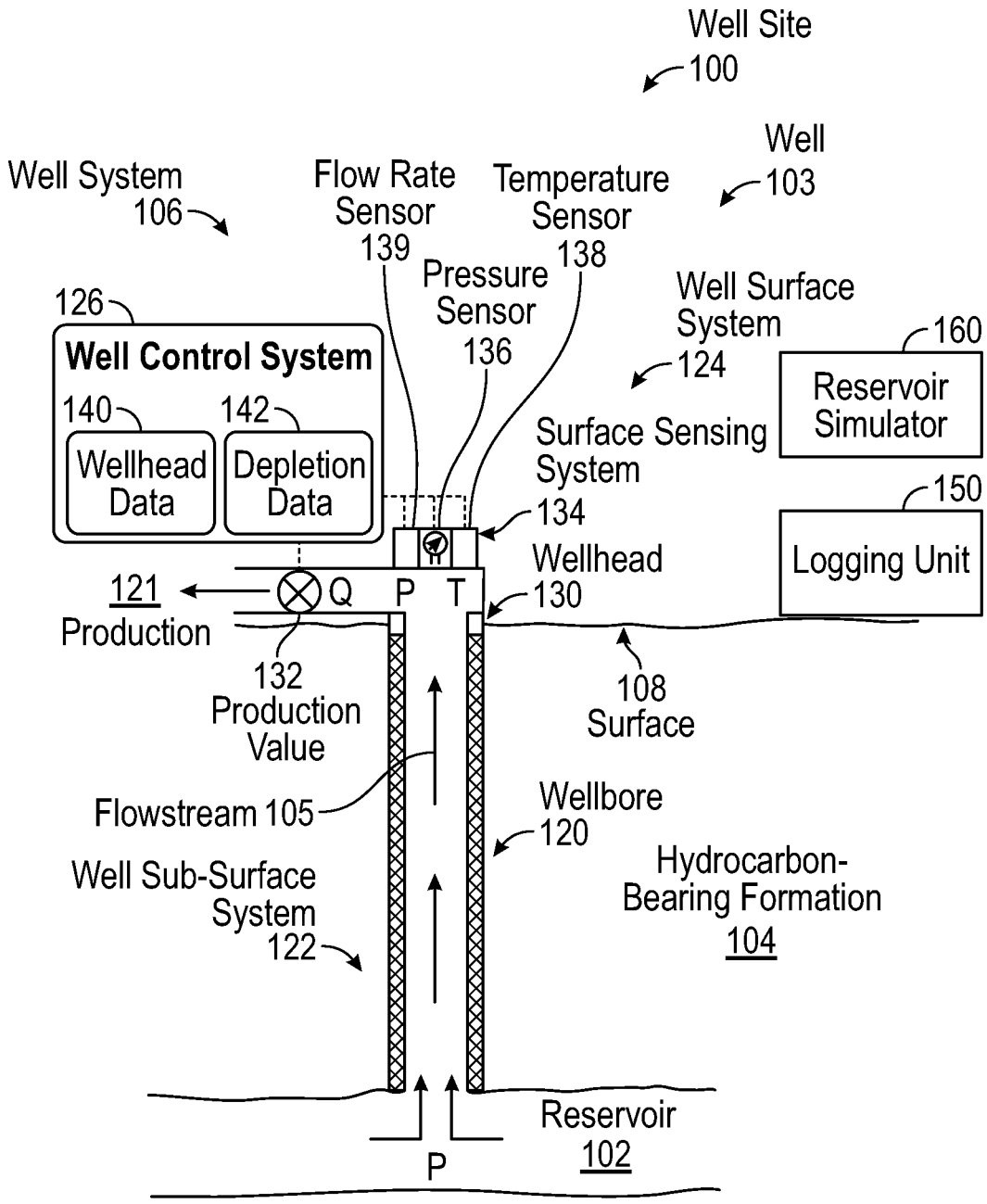
FIGS. 1, 2, 3, 4A, 4B, 5A, 5B, 6A, 6B, and 6C show example systems in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for reducing the probability of having malfunctions from sensors coupled to instruments such as a production logging tool (PLT) that is deployed in a flowstream of a wellbore of a well. The production logging operations may occur in horizontal oil and water wells to record the production profile and to optimize the production from these wells. In a large oilfield the production logging tool operations may number in the hundreds on an annual basis. Accurate recording of wells may be impaired due to emulsion-like crude production and/or wells with viscid or sticky materials. Viscid materials may be deposited on the sensors and may impact the measurements taken by the sensors while in the flowstream.

In accordance with one or more embodiments, the PLT may have sensors arranged at an exterior of the main body of the PLT such that the sensors are exposed to the flowstream. In particular, monitoring operating parameters such as quantifying the constituents of a multiphase flow in a flowstream may prove difficult in a wellbore due to contamination accumulating on or around the sensors. The multiphase flow may include low API gravity (heavy) constituents with a consistency like grease, having a sticky or viscid characteristic that makes them conducive to interfering with or being deposited on the sensors.

Rather than pulling the PLT from the bore, embodiments disclosed herein provide a system for reducing the probability of having malfunctions from the sensors due to deposits of viscid materials on the various sensors. Various PLT systems may include a logging tool upper part and a logging tool lower part disposed on a logging tool axis and connected together by a body actuator. Some embodiments may include a sleeve, such as a protective sleeve, to protect the sensors from sticky materials and from damage, such as impacts with the wellbore surfaces and components, during deployment of the PLT. Further, one or more embodiments may include a mechanical cleaner comprising a sleeve actuator and a set of fiber bristles coupled to the protective sleeve and arranged to brush against the sensors upon actuation of the protective sleeve. The PLT may use two different and complimentary functions to remove the deposited viscid materials. The PLT may have a chemical cleaning function comprising pumping a chemical such as a solvent onto the sensors to dissolve or otherwise remove the viscid materials. In one or more embodiments, the PLT includes a mechanical cleaning function involving brushing the sensors with fiber bristles to mechanically remove the viscid materials. Remote actuation enables the cleaning without having to remove the PLT from the flowstream. In this manner, the application of chemicals and the brushing of fiber bristles may clean the sticky materials off of the sensors, thereby restoring the performance of the sensors and reducing the probability of sensor malfunctions.

Turning to FIG. 1, FIG. 1 shows a schematic diagram in accordance with one or more embodiments. As shown FIG. 1 illustrates a wellsite 100 that includes a well 103, a hydrocarbon reservoir (a reservoir 102) located subsurface in a hydrocarbon-bearing formation 104, and a well system 106. The hydrocarbon-bearing formation 104 may include a porous or fractured rock formation that resides underground, beneath the surface 108 of the earth. In the case of the well system 106 being a hydrocarbon well, the reservoir 102 may include a portion of the hydrocarbon-bearing formation 104. The hydrocarbon-bearing formation 104 and the reservoir 102 may include different layers of rock having varying characteristics, such as varying degrees of permeability, porosity, and resistivity. In the case of the well system 106 being operated as a production well, the well system 106 may facilitate the extraction of hydrocarbons (known as production) from the reservoir 102.

Figure 8:
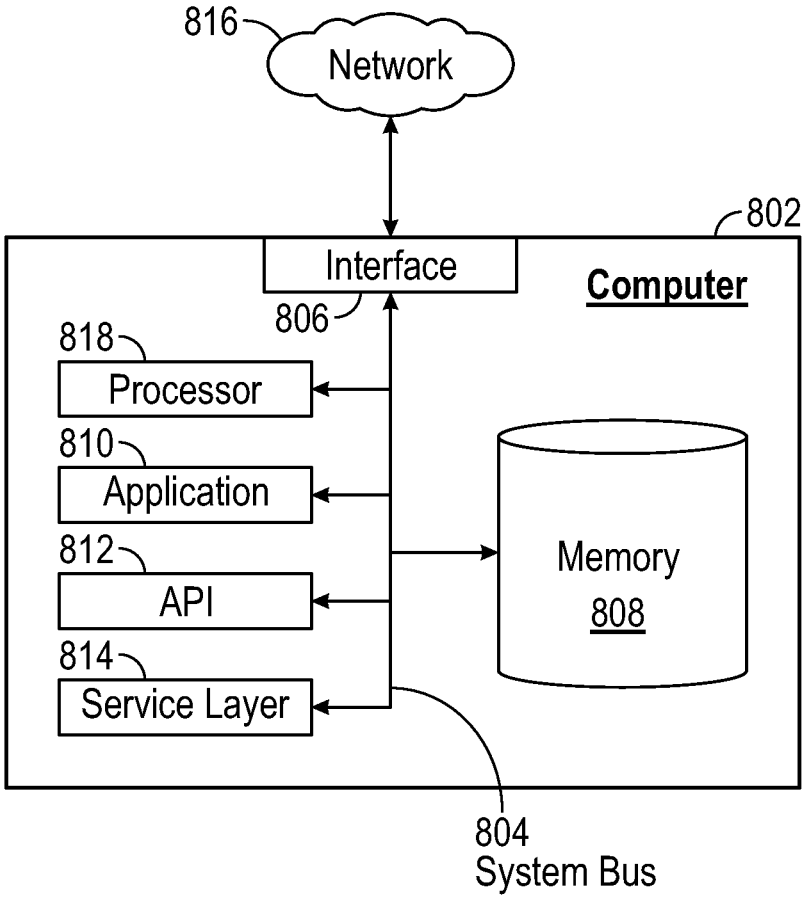
FIG. 8 shows a computer system in accordance with one or more embodiments.

In some embodiments, the well system 106 includes a wellbore 120, a well sub-surface system 122, a well surface system 124, and a control system 126 for the well. The control system 126 may control various operations of the well system 106, such as well production operations, well completion operations, well maintenance operations, and reservoir monitoring, assessment, and development operations. In some embodiments, the control system 126 includes a computer system that is the same as or similar to the computer system (a computer 802) described below in FIG. 8 and the accompanying description.

The wellbore 120 may include a bored hole that extends from the surface 108 into a target zone of the hydrocarbon-bearing formation 104, such as the reservoir 102. An upper end of the wellbore 120, terminating at or near the surface 108, may be referred to as the "up-hole" end of the wellbore 120, and a lower end of the wellbore, terminating in the hydrocarbon-bearing formation 104, may be referred to as the "down-hole" end of the wellbore 120. The wellbore 120 may facilitate the circulation of drilling fluids during drilling operations, the flow (a flowstream 105) of hydrocarbon production (production 121) (e.g., oil and gas) from the reservoir 102 to the surface 108 during production operations, the injection of substances (e.g., water) into the hydrocarbon-bearing formation 104 or the reservoir 102 during injection operations, or the communication of monitoring devices (e.g., logging tools) into the hydrocarbon-bearing formation 104 or the reservoir 102 during monitoring operations (e.g., during in situ logging operations).

In some embodiments, during operation of the well system 106, the control system 126 collects and records wellhead data 140 and depletion data 142 for the well system 106. The wellhead data 140 may include, for example, a record of measurements of wellhead pressure (P) (e.g., including flowing wellhead pressure (FWHP)), wellhead temperature (T) (e.g., including flowing wellhead temperature), wellhead production rate (Q) over some or all of the life of the well system 106, and water cut data. In some embodiments, the measurements are recorded in real-time, and are available for review or use within seconds, minutes or hours of the condition being sensed (e.g., the measurements are available within 1 hour of the condition being sensed). In such an embodiment, the wellhead data 140 may be referred to as real-time wellhead data. Real-time wellhead data may enable an operator of the well system 106 to assess a relatively current state of the well system 106 and make real-time decisions regarding development of the well system 106 and the reservoir 102, such as on-demand adjustments in regulation of production flow from the well.

With respect to water cut data, the well system 106 may include one or more water cut sensors. For example, a water cut sensor may be hardware and/or software with functionality for determining the water content in oil, also referred to as "water cut." Measurements from a water cut sensor may be referred to as water cut data and may describe the ratio of water produced from the wellbore 120 compared to the total volume of liquids produced from the wellbore 120. Water cut sensors may implement various water cut measuring techniques, such as those based on capacitance measurements, Coriolis effect, infrared (IR) spectroscopy, gamma ray spectroscopy, and microwave technology. Water cut data is obtained during production operations to determine various fluid rates found in production from the well system 106. This water cut data is used to determine water-to-gas information regarding the wellhead 130.

In some embodiments, a water-to-gas ratio (WGR) is determined using a multiphase flow meter. For example, a multiphase flow meter may use magnetic resonance information to determine the number of hydrogen atoms in a particular fluid flow. As oil, gas, and water all contain hydrogen atoms, a multiphase flow may be measured using magnetic resonance. In particular, a fluid may be magnetized and subsequently excited by radio frequency pulses. The hydrogen atoms may respond to the pulses and emit echoes that are subsequently recorded and analyzed by the multiphase flow meter.

In some embodiments, the well surface system 124 includes a wellhead 130. The wellhead 130 may include a rigid structure installed at the "up-hole" end of the wellbore 120, at or near where the wellbore 120 terminates at the surface 108 of the Earth. The wellhead 130 may include structures for supporting (or "hanging") casing and production tubing extending into the wellbore 120. Production 121 may flow through the wellhead 130, after exiting the wellbore 120 and the well sub-surface system 122, including, for example, the casing and the production tubing. In some embodiments, the well surface system 124 includes flow regulating devices that are operable to control the flow of substances into and out of the wellbore 120. For example, the well surface system 124 may include one or more of a production valve 132 that are operable to control the flow of production 121. For example, a production valve 132 may be fully opened to enable unrestricted flow of production 121 from the wellbore 120, the production valve 132 may be partially opened to partially restrict (or "throttle") the flow of production 121 from the wellbore 120, and production valve 132 may be fully closed to fully restrict (or "block") the flow of production 121 from the wellbore 120, and through the well surface system 124.

Keeping with FIG. 1, in some embodiments, the well surface system 124 includes a surface sensing system 134. The surface sensing system 134 may include sensors for sensing characteristics of substances, including production 121, passing through or otherwise located in the well surface system 124. The characteristics may include, for example, pressure, temperature, and flow rate of production 121 flowing through the wellhead 130, or other conduits of the well surface system 124, after exiting the wellbore 120.

In some embodiments, the surface sensing system 134 includes a surface pressure sensor 136 operable to sense the pressure of production 121 flowing through the well surface system 124, after it exits the wellbore 120. The surface pressure sensor 136 may include, for example, a wellhead pressure sensor that senses a pressure of production 121 flowing through or otherwise located in the wellhead 130. In some embodiments, the surface sensing system 134 includes a surface temperature sensor 138 operable to sense the temperature of production 121 flowing through the well surface system 124, after it exits the wellbore 120. The surface temperature sensor 138 may include, for example, a wellhead temperature sensor that senses a temperature of production 121 flowing through or otherwise located in the wellhead 130, referred to as "wellhead temperature" (T). In some embodiments, the surface sensing system 134 includes a flow rate sensor 139 operable to sense the flow rate of production 121 flowing through the well surface system 124, after it exits the wellbore 120. The flow rate sensor 139 may include hardware that senses a flow rate of production 121 (Q) passing through the wellhead 130.

In some embodiments, the well system 106 includes a reservoir simulator 160. For example, the reservoir simulator 160 may include hardware and/or software with functionality for generating one or more reservoir models regarding the hydrocarbon-bearing formation 104 and/or performing one or more reservoir simulations. For example, the reservoir simulator 160 may store well logs and data regarding core samples for performing simulations. A reservoir simulator may further analyze the well log data, the core sample data, seismic data, and/or other types of data to generate and/or update the one or more reservoir models. While the reservoir simulator 160 is shown at a well site, embodiments are contemplated where reservoir simulators are located away from well sites. In some embodiments, the reservoir simulator 160 may include a computer system that is similar to the computer system (the computer 802) described below with regard to FIG. 8 and the accompanying description.

In some embodiments, the well system 106 includes a logging unit 150. For example, the logging unit 150 may include hardware and/or software with functionality for generating one or more well logs regarding the hydrocarbon-bearing formation 104 and/or acquiring the data used in generating the well logs. The well logs may be acquired downhole within the wellbore 120 located within the reservoir 102 using the logging unit 150. The logging unit 150 may include, for example, an optical logging tool, an acoustic logging tool, and a resistivity logging tool. Thus, the well log acquired from the logging unit 150 may be an optical log, an acoustic log, or resistivity image log. In some embodiments, the logging unit 150 includes a computer system that is the same as or similar to that of the computer system (a computer 802) described below in FIG. 8 and the accompanying description.

Figure 2:
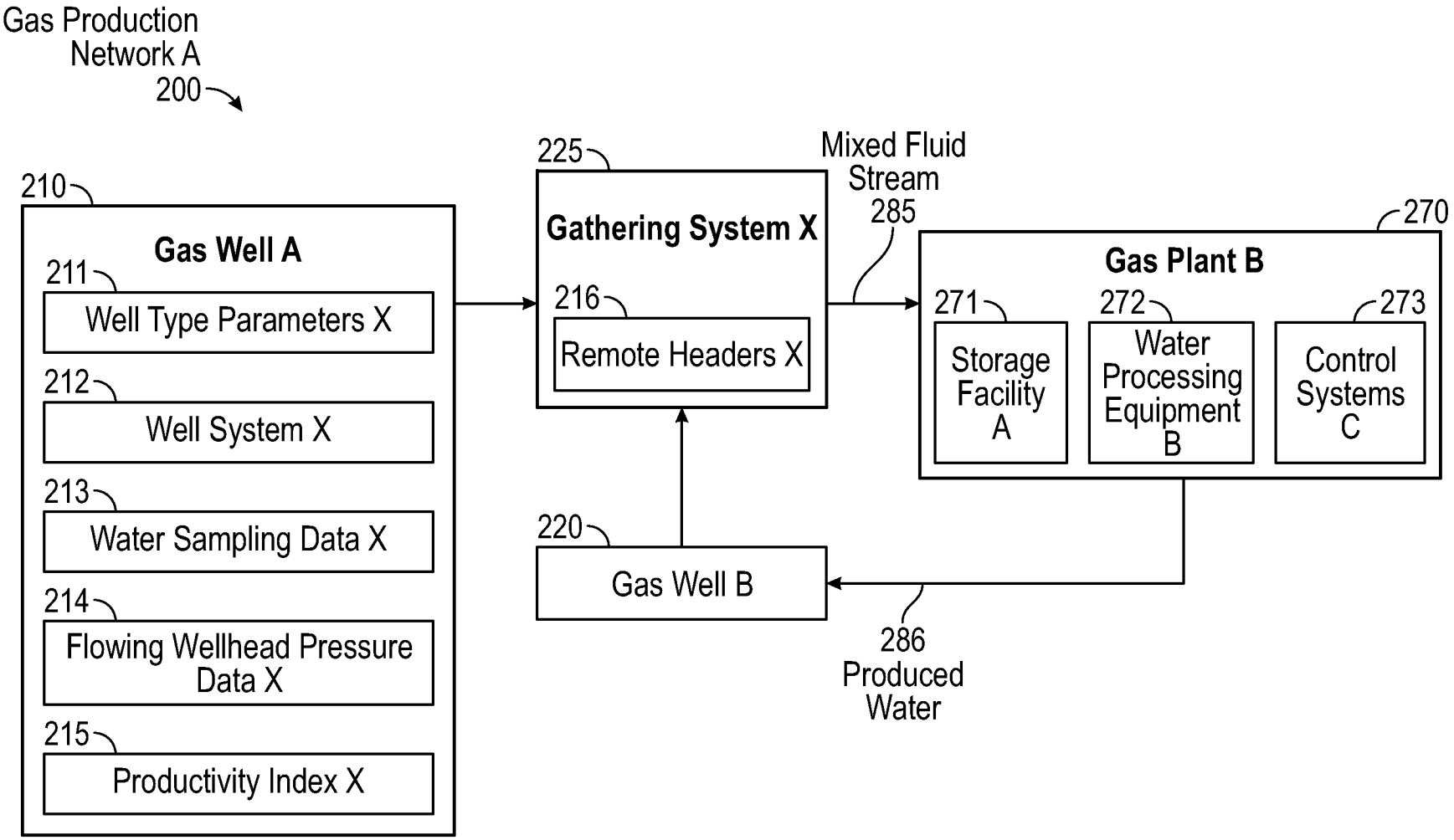

FIG. 2 shows a schematic diagram in accordance with one or more embodiments. As shown in FIG. 2, a gas production network (e.g., gas production network A 200) may include various gas wells (e.g., gas well A 210, gas well B 220), various gas plants (e.g., gas plant B 270), various control systems (e.g., control systems C 273), various network elements (not shown), and/or a gas supply manager (not shown). A gas well may include a well system (e.g., well system X 212) that is similar to well system 106 described above in FIG. 1 and the accompanying description. In some embodiments, various types of gas well data are collected over the gas production network, such as water sampling data (e.g., water sampling data X 213), flowing wellhead pressure data (e.g., flowing wellhead pressure data X 214), productivity index information (e.g., productivity index X 215). Likewise, the gas production network may also collect various well type parameters (e.g., well type parameters X 211) that describe various gas well characteristics, such as reservoir type, completion type, and surface facility conditions.

In some embodiments, one or more gas wells are coupled to a gathering system (e.g., gathering system X 225). A gathering system (also referred to as a collecting system or gathering facility) may include various hardware arrangements that connect flowlines from several gas wells into a single gathering line. For example, a gathering system may include flowline networks, headers, pumping facilities, separators, emulsion treaters, compressors, dehydrators, tanks, valves, regulators, and/or associated equipment. In particular, a remote header (e.g., remote headers X 216) may have production valves and testing valves to control a mixed stream for a flowline of a respective gas well. Thus, a gathering system may direct various hydrocarbon fluids to a processing or testing facility, such as a gas plant. In some embodiments, a gathering system manages individual fluid ratios (e.g., a particular gas-to-water ratio or condensate-to-gas ratio) as well as supply rates of oil, gas, and water. For example, a gathering system may assign a particular production value or ratio value to a particular gas well by opening and closing selected valves among the remote headers and using individual metering equipment or separators. Furthermore, a gathering system may be a radial system or a trunk line system. A radial system brings various flowlines to a single central header. In contrast, a trunk-line system uses several remote headers to collect oil and gas from fields that cover a large geographic area. Once collected, the gathering system may transport and control the flow of oil or gas to a storage facility, a gas processing plant, or a shipping point.

Keeping with FIG. 2, gas is transported from one or more gas wells (e.g., gas well A 210) to one or more gas plants (e.g., gas plant B 270), such as through one or more mixed fluid streams (e.g., mixed fluid stream 285). More specifically, a gas plant may refer to various types of industrial plants such as a gas processing plant, a gas cycling plant, or a compressor plant. A gas processing plant (also referred to as a natural gas processing plant) is a facility that processes natural gas to recover natural gas liquids (e.g., condensate, natural gasoline, and liquefied petroleum gas) and sometimes other substances such as sulfur. A gas cycling plant may refer to an oilfield installation coupled to a gas-condensate reservoir. In particular, a gas cycling plant may extract various liquids from natural gas. Consequently, the remaining dry gas may be compressed prior to return to a producing formation, e.g., to maintain reservoir pressure. Moreover, various components of natural gas may be classified according to their vapor pressures, such as low-pressure liquid (i.e., condensate), intermediate pressure liquid (i.e., natural gasoline), and high-pressure liquid (i.e., liquefied petroleum gas). Examples of natural gas liquids include propane, butane, pentane, hexane, and heptane. A compressor plant is a facility that includes multiple compressors, auxiliary treatment equipment, and pipeline installations for pumping natural gas over long distances. A compressor station may also repressurize gas in large gas pipelines or to link offshore gas fields to their final terminals.

Keeping with gas plants, a gas plant may include water processing equipment (e.g., water processing equipment B 272) that includes hardware and/or software for extracting, treating, and/or disposing of water associated with gas processing. More specifically, a gas plant may extract produced water (e.g., produced water 286) during the separation of oil or gas from a mixed fluid stream (e.g., mixed fluid stream 285) acquired from a gas well. This produced water is a kind of brackish and saline water brought to the surface from underground formations. In particular, oil and gas reservoirs may have water in addition to hydrocarbons in various zones underneath the hydrocarbons, and even in the same zone as the oil and gas. However, most produced water is of very poor quality and may include high levels of natural salts and minerals that have dissociated from geological formations in the target reservoir. Likewise, produced water may also acquire dissolved constituents from fracturing fluids (e.g., substances added to the fracturing fluid to help prevent pipe corrosion, minimize friction, and aid the fracking process). However, through various water treatments, produced water may be reused in one or more gas wells, e.g., through waterflooding where produced water is injected into the reservoirs. By injecting produced water into an injection well, the injected water may force oil and gas to one or more production wells.

Keeping with produced water, a gas plant may use various treatment technologies in order to reuse or dispose of produced water, such as conventional treatments and advanced treatments. For example, conventional treatments may include flocculation, coagulation, sedimentation, filtration, and lime softening water treatment processes. Thus, conventional treatment processes may include functionality for removing suspended solids, oil and grease, hardness compounds, and other nondissolved water components. With advanced treatment technologies, water processing equipment may include functionality for performing reverse osmosis membranes, thermal distillation, evaporation and/or crystallization processes. These advanced treatment technologies may treat dissolved solids, such as chlorides, salts, barium, strontium, and sometimes dissolved radionuclides. In some embodiments, produced water is sent to a wastewater treatment plant that is equipped to remove barium and strontium, e.g., using sulfate precipitation. Outside of treatments for reusing produced water, water processing equipment may dispose of produced water using various water management options. For example, produced water may be disposed in saltwater wells. Likewise, produced water may also be eliminated through a deep well injection.

In some embodiments, a gas plant may include one or more storage facilities (e.g., storage facility A 271) and one or more of control systems (e.g., control systems C 273). For example, different forms of gas may be stored in various storage facilities that include surface containers as well as various underground reservoirs, such as depleted gas reservoirs, aquifer reservoirs and salt cavern reservoirs. With respect to control systems, a control system may include hardware and/or software that monitors and/or operates equipment, such as at a gas well or in a gas plant. Examples of control systems may include one or more of the following: an emergency shut down (ESD) system, a safety control system, a video management system (VMS), process analyzers, other industrial systems, etc. In particular, a control system may include a programmable logic controller that may control valve states, fluid levels, pipe pressures, warning alarms, pressure releases and/or various hardware components throughout a facility. Thus, a programmable logic controller may be a ruggedized computer system with functionality to withstand vibrations, extreme temperatures, wet conditions, and/or dusty conditions, such as those around a refinery or drilling rig.

With respect to distributed control systems, a distributed control system may be a computer system for managing various processes at a facility using multiple control loops. As such, a distributed control system may include various autonomous controllers (such as remote terminal units) positioned at different locations throughout the facility to manage operations and monitor processes. A distributed control system may include no single centralized computer for managing control loops and other operations. On the other hand, a SCADA system (supervisory control and data acquisition may include a control system that includes functionality for enabling monitoring and issuing of process commands through local control at a facility as well as remote control outside the facility. With respect to a remote terminal unit (RTU), an RTU may include hardware and/or software, such as a microprocessor, that connects sensors and/or actuators using network connections to perform various processes in the automation system.

Keeping with control systems, a control system may be coupled to facility equipment. Facility equipment may include various machinery such as one or more hardware components that may be monitored using one or more sensors. Examples of hardware components coupled to a control system may include crude oil preheaters, heat exchangers, pumps, valves, compressors, loading racks, and storage tanks among various other types of hardware components. Hardware components may also include various network elements or control elements for implementing control systems, such as switches, routers, hubs, PLCs, remote terminal units, user equipment, or any other technical components for performing specialized processes. Examples of sensors may include pressure sensors, torque sensors, rotary switches, weight sensors, position sensors, microswitches, hydrophones, accelerometers, etc. A gas supply manager, user devices, and network elements may be computer systems similar to the computer system (the computer 802) described in FIG. 8 and the accompanying description.

Figure 3:
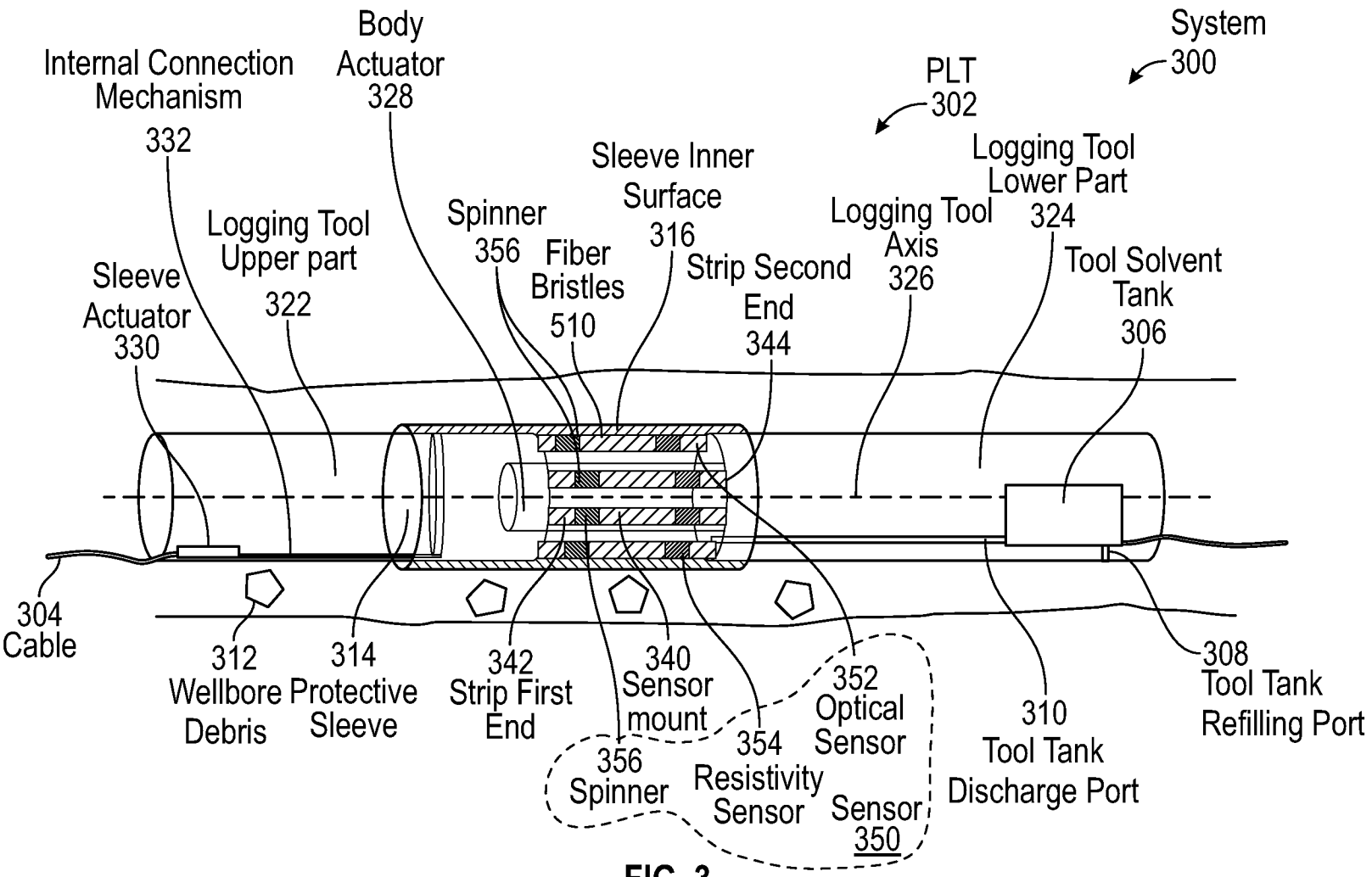

Turning to FIG. 3, FIG. 3 shows a schematic diagram in accordance with one or more embodiments. As illustrated in FIG. 3, a production logging tool (PLT) system, (e.g., a system 300) may include a production logging tool (a PLT 302). The PLT may be deployed into wellbore 120 of well 103 using coiled tubing, wireline, or a logging unit, (e.g., a logging unit 150) at the surface 108 of the wellsite 100. In one or more embodiments, the PLT has a production logging tool upper part (e.g., logging tool upper part 322) with an axis (e.g., logging tool axis 326). The PLT also has a production logging tool lower part (e.g., a logging tool lower part 324) arranged below the upper part and on the axis. A tool piston (e.g., body actuator 328) may couple the upper part to the lower part. The body actuator moves the upper part of the tool downward closer to the lower part. In this manner, the body actuator may translate the upper part and the lower part along the logging tool axis.

FIG. 3 shows that the PLT has at least one sensor 350. The sensors on the PLT may include at least one of an optical sensor 352, a resistivity sensor 354, and/or a spinner 356 described in FIG. 4B. Other types of sensors to support the measurement function are also contemplated. The PLT may include a moveable sensor mount (e.g., sensor mount 340) with a first end (e.g., a strip first end 342) and a second end (e.g., a strip second end 344). The strip first end is coupled to the logging tool upper part and the strip second end is coupled to the logging tool lower part. At least one sensor 350 is disposed on the sensor mount and configured to acquire well data of the flowstream 105 in the wellbore 120 of the well 103. The sensor mount may be substantially parallel when the logging tool upper part 322 and the logging tool lower part 324 are translated at a distance apart from each other. In this manner, the sensors on the flexible metal strips of the sensor mount 340 are held in a position closer toward the logging tool axis 326, i.e., the sensors are held in a substantially recessed position. The sensor mount may bow outward (bend in a convex shape out from the tool toward the bore) away from the logging tool axis 326 when the logging tool upper part 322 and the logging tool lower part 324 are translated at a distance closer to each other. The sensor may record data such as operational parameters to quantify the constituents of the flowstream. In this manner, the sensor may form a well log.

Figures 5A, 5B:
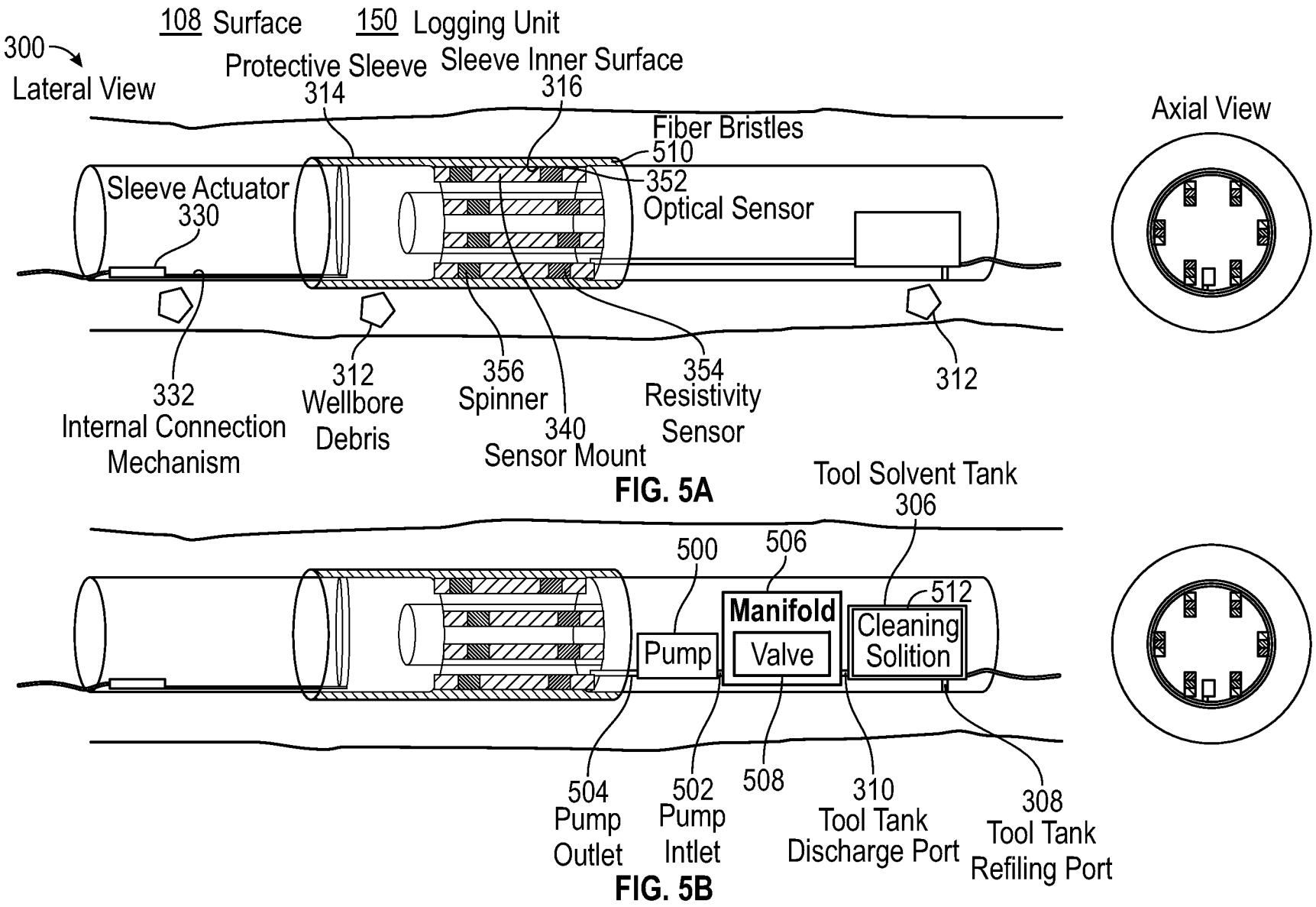

The PLT may also include a sleeve (e.g., a protective sleeve 314) with an inner surface (e.g., a sleeve inner surface 316). In one or more embodiments, the sleeve is used to cover the sensor to prevent contamination by wellbore debris 312. In further embodiments, the sleeve also serves as a cleaning sleeve as shown in FIG. 5A. The sleeve may be positioned on the logging tool axis. In some embodiments the sleeve may have a sleeve axis which corresponds to the logging tool axis 326. In other embodiments, the sleeve axis may be offset from the logging tool axis. In one or more embodiments, a sleeve connector (e.g., an internal connection mechanism 332) connects a sleeve actuator 330 to the protective sleeve 314. The sleeve actuator 330 is configured to retract the protective sleeve 314 to uncover the sensors.

Any combination of bearings and fasteners may be used for coupling bodies, sleeves, and actuators. For example, bearings and fasteners may couple the upper body and/or the lower body to each other and/or to the body actuator 328. Bearings and fasteners may couple the sleeve to the upper body and/or the lower body. Bearings and fasteners may couple the sleeve to the sleeve actuator. Bearings and fasteners may couple the straps to the upper body and/or to the lower body. Bearings and fasteners may include any combination of bearings, slots, rails, bushings, wheels, pins, studs, nuts, screws, and bolts. Bearings may include linear bearings, sliding bearings such as ball bearings, cylindrical roller bearings, spherical roller bearings, tapered roller bearings, and/or journal bearings on one, some, or all of the bodies, sleeves, and actuators. Any suitable coupler providing similar functionality to that described may also be implemented without departing from the scope of the present disclosure. The components of system 300 may be constructed of high-strength, corrosion-resistant material to minimize corrosion when in its intended environment such as in the flowstream. In one or more embodiments, an electrical cable, a fiber optic cable, a power cable, a hydraulic line, and/or other communication and/or power system may be used to connect some or all of the components of system 300 (hereafter, e.g., a cable 304). The cable may also be configured to transmit current, keep control over the system, and provide connection to the logging unit 150 and/or other systems at surface 108. The system 300 may include additional PLTs that are connected in series or parallel in the same or in other flowstreams. The cable 304 may be configured to transmit current, keep control over the system, and provide connection to the additional PLTs.

Continuing with FIG. 3, system 300 may include a conduit for conveying useful materials to the PLT 302. For example, system 300 may include the hydraulic line from the surface to provide hydraulic pressure to the PLT. The hydraulic line may be bundled with the cable 304. Useful materials may include liquids such as the hydraulic fluid, the cleaning solutions, and water. Useful materials may include gasses such as compressed air or nitrogen. Further, useful materials may include solids such as powders or abrasives. The PLT may also include a cleaning reservoir (e.g., a tool solvent tank 306) with a reservoir inlet (e.g., a tool tank refilling port 308) and a reservoir outlet (e.g., a tool tank discharge port 310) described in FIG. 5B.

The body actuator 328 and the sleeve actuator 330 may comprise a motion controller such as a motor (electric, hydraulic, or pneumatic), a pneumatic cylinder, a hydraulic cylinder, an in-line motor, and/or an electromagnetic linear actuator. The actuator may be integrated into one or more of the logging tool upper part 322 and/or the logging tool lower part 324. The actuator may include a motion return device such as a coil spring, a wave spring, a torsion spring, or other type spring (not shown.) The actuator may include a gaseous component such as compressed nitrogen, i.e., a gas-charged component (not shown.) The gas-charged component may be used for actuation and/or as a return device. Body actuator 328 may be coupled at a piston static end to a lower piston point on the logging tool lower part 324. Body actuator 328 may be coupled at a piston dynamic end to an upper piston point on the logging tool upper part 322. In this implementation the body actuator 328 may move the logging tool upper part 322 downward closer to the logging tool lower part 324 and back as the body actuator 328 retracts and extends.

The sleeve actuator 330 may be coupled at an actuator static end to an upper actuator point on the logging tool upper part 322 (not shown.) Sleeve actuator 330 may be coupled at an actuator dynamic end to a lower actuator point on the logging tool lower part 324. In this implementation, the sleeve actuator 330 moves the protective sleeve 314 upward over the logging tool upper part 322 and back as the sleeve actuator 330 retracts and extends.

The body actuator 328 and/or the sleeve actuator 330 may include one or more of a bell-crank and/or one or more of a crankshaft with a linkage for moving the coupled components (not shown.) For example, the body actuator 328 may move the logging tool upper part 322 using the linkage and the sleeve actuator 330 may move the protective sleeve 314 using the linkage.

The body actuator 328 and/or the sleeve actuator 330 provide motion control using a jack screw that cooperates with a jack nut (not shown.) The following illustration discloses application of the jack screw motion control to the protective sleeve 314. The jack screw may be coupled at a jack screw body end to a body first point such that the body prevents the jack screw from rotating and the body receives thrust along an axis of the jack screw. The jack nut comprises a jack nut internal thread that engages an external thread on the jack screw. The jack nut internal thread may be integrated into the sleeve. The jack screw extends through the jack nut. A jack screw second end may be coupled to a sleeve jack second point on the sleeve, or the jack screw second end may remain uncoupled. The jack screw thread may be, for example, a square thread, a trapezoidal thread such as an acme thread, or any other appropriate thread profile. The jack nut may be rotatably supported by the sleeve along an axis of the jack nut and the jack screw. The jack nut may rotate along the length of the jack screw and the jack nut may react against the sleeve. In this manner axial displacement between the jack nut and the jack screw reacts between the sleeve and the body thereby displacing the sleeve along the length of the body.

The jack nut may include a jack nut external gear profile (not shown.) Sleeve actuator 330 has a sleeve motion gear that engages the jack nut external gear profile such that axial rotation of the gear is transferred to rotation of the jack nut. In this manner the sleeve actuator 330 transfers its torque into axial displacement thereby displacing the sleeve along the length of the body. The jack nut gear and the sleeve motion gear corresponding to the jack nut gear may be, for example, a worm gear or a pinion gear. The jack nut gear and the sleeve motion gear may be a straight-cut gear, a spiral bevel gear, a helical-cut gear, a hypoid gear, or any other appropriate gear style. This arrangement may be applied in like manner to motion of the logging tool upper part 322 for displacement of the upper part along the logging tool axis 326.

In accordance with one or more embodiments the system 300 may implement any combination of gears, sprockets, wheels, cylinders, motors, shafts, bearings, motion control, etc. providing similar functionality to that described without departing from the scope of the present disclosure.

Figure 4A:
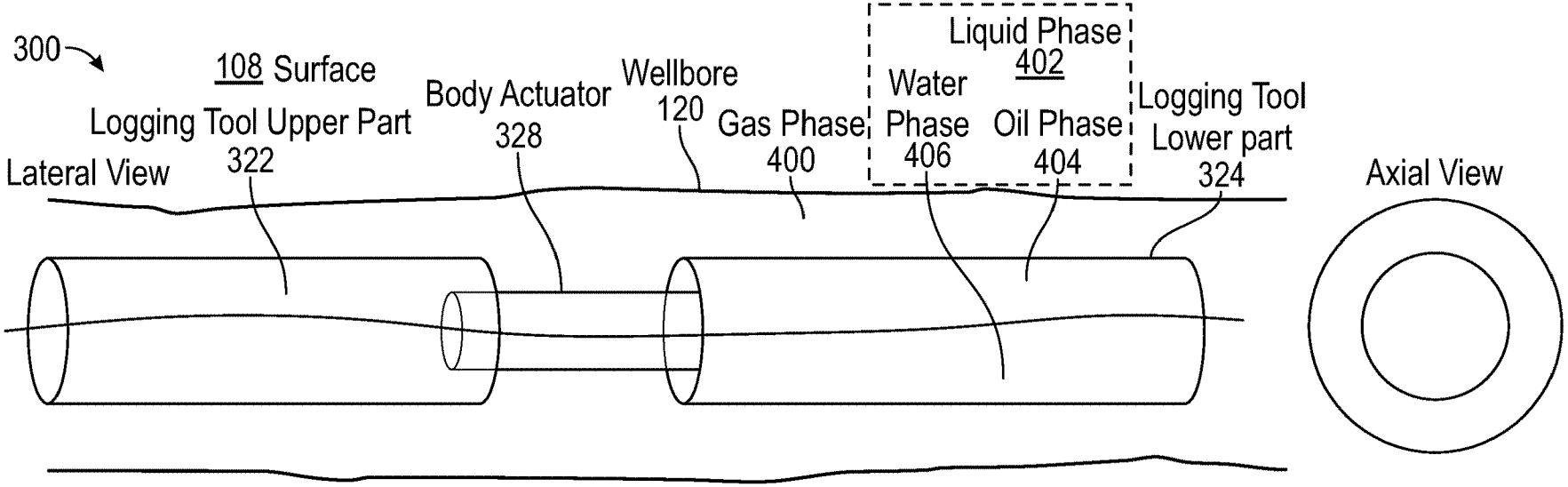
Figure 4B:
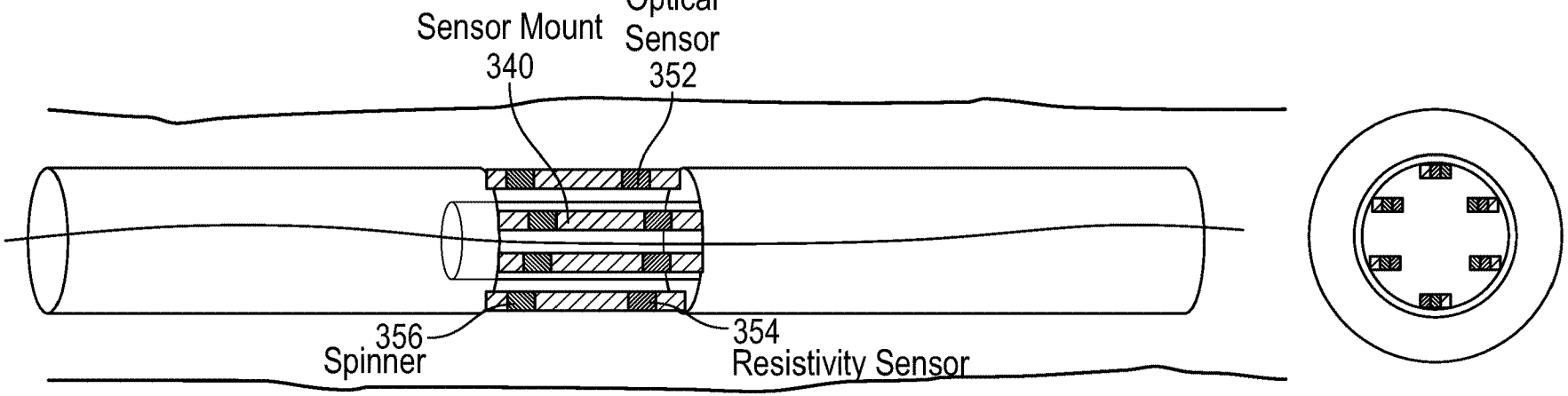

FIG. 4A shows both a lateral and axial view of the PLT 302 with the sensor mounts removed for clarity. FIG. 4B shows a lateral and axial view of the PLT 302 with the sensor mount 340 and the sensors. FIGS. 4A and 4B show that the PLT has the two main body parts. The two main body parts include the upper part (e.g., the logging tool upper part 322) and the lower part (e.g., the logging tool lower part 324). A third main part is the piston (e.g., the body actuator 328) in the middle. The piston may pull the upper part and the lower part closer to each other and may be used to push the upper part and the lower part away from each other.

FIG. 4B shows that the PLT may have, for example, quantity six flexible metal strips (e.g., as part of the sensor mount 340). The strips are disposed between the upper body part and the lower body part. The quantity of the flexible metal strips may vary without departing from the scope of this disclosure. In various embodiments the strips are substantially evenly distributed around the 360-degree circumference of the PLT. The metal strips are configured to be distributed at various heights of the wellbore. This distribution is configured to measure various strata of the multiphase flowstream. The various strata correspond to the various phases and/or densities of the multiphase flow. In a horizontal well, the axis of the wellbore may be substantially parallel with the surface 108 (FIG. 1). In this sense the height refers to the orientation of a wellbore of a horizontal well that is closer to the surface 108 and away from the axis of the wellbore toward the wall of the wellbore. For instance, in the wellbore of a horizontal well, a gas phase 400 may accumulate near the top wall of the wellbore. A liquid phase 402 may accumulate near the bottom wall of the wellbore. An oil phase 404 may accumulate nearer the middle/nearer the axis of the wellbore. The multiphase flow may include a water phase 406. In accordance with one or more embodiments the PLT may include sensors to detect the water phase 406. In accordance with one or more embodiments the system 300 may comprise a directional/gravimetric sensor on tool for orienting the PLT in the well.

FIG. 4B shows that each strip may be equipped with, for example, two sensors on each strip and that each of the two sensors may be different types one from another. For example, the first sensor shown in an uphole location may be a spinner (e.g., the spinner 356) to measure the flowrate data of the flowstream. The second sensor shown downhole from the first sensor may be optical sensor 352 or a resistivity sensor 354. The optical sensor 352 is used to distinguish between gas and liquid phases. The resistivity sensor 354 is used to distinguish between oil and water phases. In various usage conditions the optical sensor 352 may be located on the side of the PLT in proximity to the gas phase 400. The resistivity sensor 354 may be located on the side of the PLT in proximity to the liquid phase 402.

Turning to FIG. 5A and FIG. 5B, FIG. 5A shows both a lateral and axial view of the PLT 302 with the protective sleeve 314 covering the sensors. FIG. 5B shows a lateral and axial view of the PLT 302 with the chemical cleaning components. FIG. 5A show that the sleeve (e.g., protective sleeve 314) is installed along the PLT axis and covering the metal strips (e.g., sensor mount 340) and the sensors (e.g., optical sensor 352, resistivity sensor 354, and spinner 356). The sleeve provides protection from the viscid and sticky materials and other debris (e.g., wellbore debris 312). The sleeve may be operated remotely to expose or to cover the sensors and the metal strips. The motor (e.g., sleeve actuator 330) may be used to operate the sleeve. The actuation of the sleeve may be controlled remotely at the surface 108 (FIG. 1) from the logging unit 150 (FIG. 1). The motor may cooperate with the sleeve connector (e.g., internal connection mechanism 332) to operate the sleeve axially, i.e., along the longitudinal axis of the PLT. The motor and connector may operate the sleeve rotationally around the circumference of the PLT. The motor and connector may operate the sleeve in any combination of rotation and translation without departing from the scope of the present disclosure. For example, the upper body may have a groove formed in an upper body outer surface and in a helical shape along the PLT axis. The sleeve may have a pin that engages the groove such that the sleeve follows the helical path as the sleeve translates along the PLT axis.

FIG. 5A shows that the protective sleeve 314 may include a brush or a set of bristles (e.g., fiber bristles 510) disposed on an inner surface of the sleeve (e.g., sleeve inner surface 316). The brush may be configured to contact the sensors and, in this manner, the protective sleeve also works as a cleaning sleeve. The brush may be made of, for example, a natural fiber, a synthetic fiber, and/or a metal. Natural fibers include boar bristle, horsehair, tampico, and others. Metals include brass, carbon steel, stainless steel, and others. Synthetic fibers include nylon, polyethylene, and others.

FIG. 5B shows that the PLT may include the tank (e.g., tool solvent tank 306), the tool tank refilling port 308, and the tool tank discharge port 310. The tank may be filled at surface 108 through the tool tank refilling port 308 with a solvent-like material such as a cleaning solution (e.g., cleaning solution 512). The tank may be filled at surface prior to running the tool in the wellbore. In various embodiments the cleaning solution may be provided to the sensors through a cleaning solution conduit from a remote location such as surface 108 (FIG. 1). The cleaning solution may be pressurized to optimize decontamination of the sensors. The cleaning solution may be distributed in a manner to optimize contact with the sensors. For example, the pressurized cleaning solution may be sprayed out of a nozzle. The cleaning solution may be distributed around the internal diameter of the sleeve. The PLT may include a pump 500 to pressurize the cleaning solution. The PLT may include a manifold (e.g., manifold 506) in hydraulic communication with the tank and/or the pump. The manifold may include at least one valve such as a manifold valve (valve 508) to control a cleaning flow of the cleaning solution. The manifold may be in hydraulic communication with the tool tank discharge port 310 and a pump inlet 502. The pump may draw the cleaning solution from the tool tank discharge port 310 through the manifold valve in the manifold into the pump inlet. The pump may pressurize the cleaning solution and then may direct the cleaning solution from a pump outlet 504 onto the at least one sensor. The tank may be refilled through the tool tank refilling port 308 using the cleaning solution conduit.

The cleaning solution may be pressurized water and/or the cleaning solution may comprise one or more of a solvent, surfactant, detergent, an acid, a remover of scale and/or corrosion, or an inhibitor of scale, corrosion, and/or amines. The cleaning solution may comprise a cleaning fluid at a temperature that varies from the ambient temperature. For example, the cleaning fluid may be at a higher temperature or a colder temperature than the downhole conditions, e.g., hot water. Critical or supercritical $CO_2$ may provide chemical energy as a strong solvent. Solvents include short or long chain alcohols, such as ethanol and decanol. The material may have any physical form, including solid, liquid, gas, or solution (in water or another solvent). The cleaning solution may comprise a solution with a solid or semisolid. For example, the cleaning solution may include sodium hydrogen carbonate carried by pressurized air in combination with pressurized water. Technologies such as bead blasting, sand blasting, and other cleaning solutions to support the cleaning of the sensors are accepted and contemplated. The cleaning solution may include a mutual solvent to perform chemical cleaning. The mutual solvent may be soluble in oil, water, or acid-based treatment fluids.

Figure 6A:
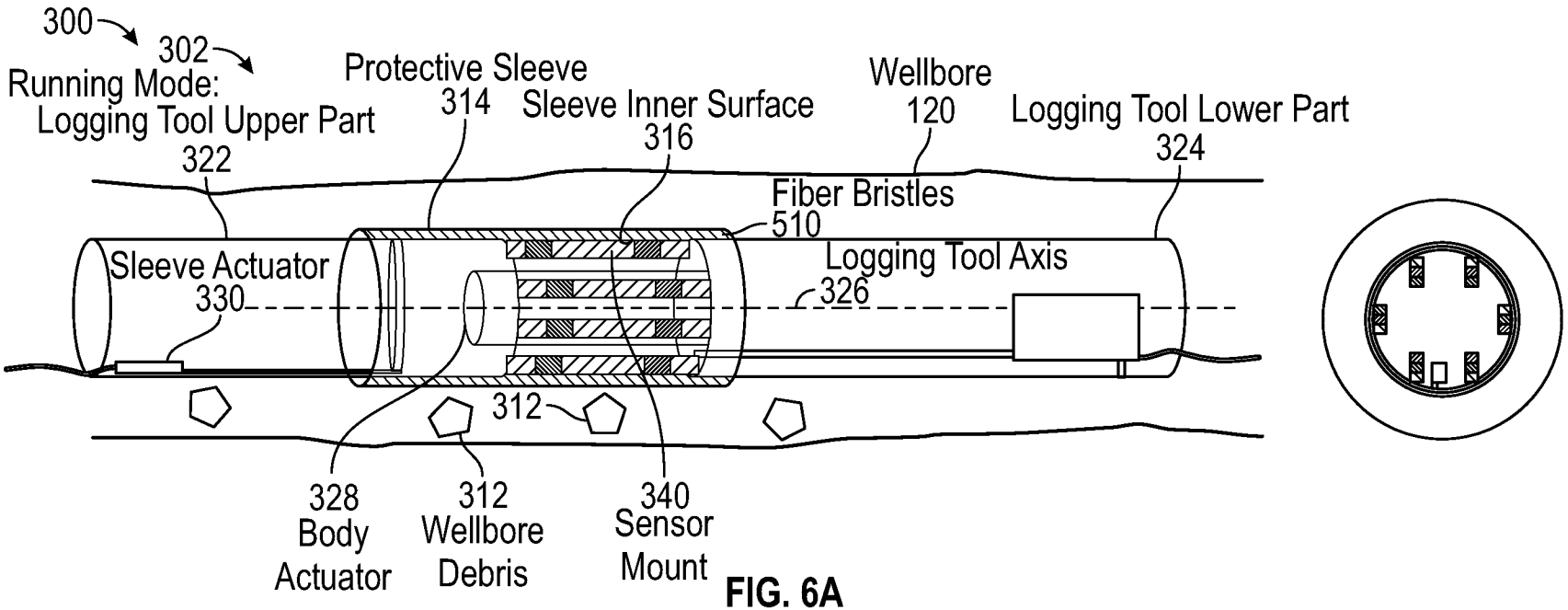
Figure 6B:
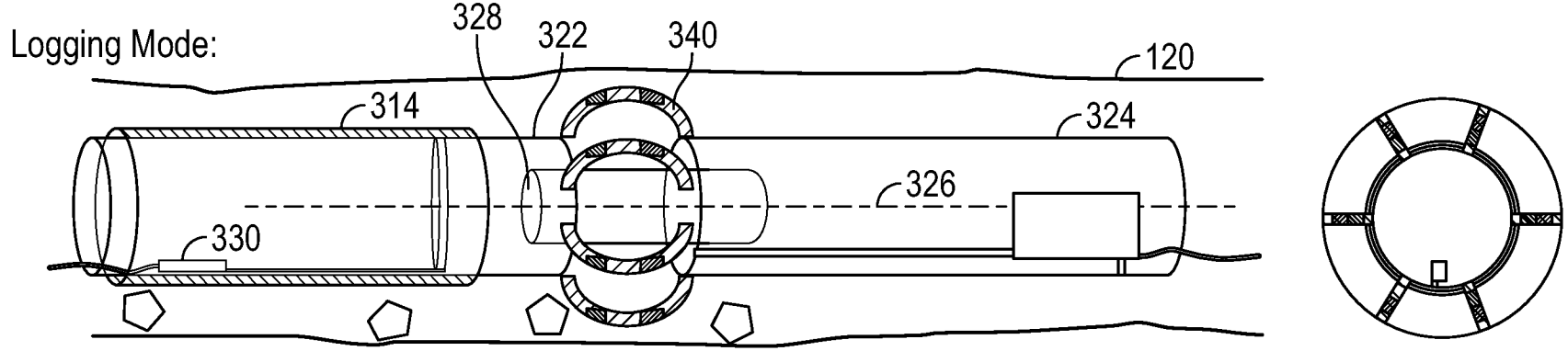
Figure 6C:
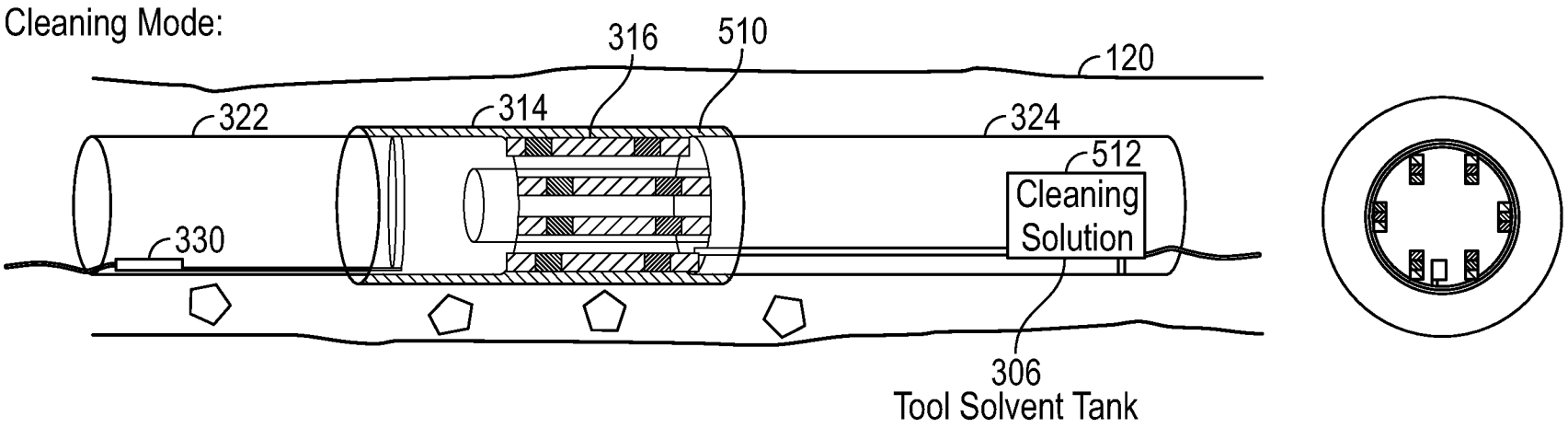

FIGS. 6A, 6B, and 6C show three exemplary modes of operation of the system 300. In FIG. 6A the first mode of operation is a running mode. This mode is anticipated for use while running the PLT 302 inside the wellbore 120 prior to the start of the logging operation. The body actuator 328 may hold the logging tool upper part 322 away from the logging tool lower part 324. In this mode the sensor mount 340 may be held in the recessed position. The sleeve actuator 330 may hold the protective sleeve 314 in a running mode position to protect the sensors. The running mode may ensure that the tool can pass through minimum restrictions within the wellbore 120 without damaging, breaking, or otherwise causing a malfunction of the sensors. The sleeve covers the sensors to protect the sensors from the wellbore debris 312 that may contact and contaminate the sensors. The protective sleeve may protect the sensors from sticky materials and from damage, such as impacts with the wellbore surfaces and components, during deployment of the PLT.

In FIG. 6B the second mode of operation is the logging mode. This mode is activated before, when, or soon after the tool is positioned at the target logging depth. The logging mode may be activated after the well is flowed for a duration of time to ensure flow stabilization. To activate logging mode, the sleeve actuator 330 may shift the protective sleeve 314 to remove the protection of the sensors thereby uncovering the sensors and exposing the sensor mount 340 and the sensors to the well fluids in the flowstream. Continuing with activating logging mode, the tool piston (e.g., body actuator 328) may move the upper part of the tool downward closer to the lower part (e.g., moving the logging tool upper part 322 down toward the logging tool lower part 324 along the logging tool axis 326). This movement closer together exposes the sensor mount 340 to a compressive force thereby causing the sensor mount 340 to buckle. The sensor mount 340 may be configured to buckle in a manner that the sensor mount 340 forms a bowed-out shape away from the logging tool axis 326. The sensor mount 340 may bow outward to a position that is a distance away from logging tool axis 326 the exceeds the distance of the outside diameters of both the logging tool upper part 322 and the logging tool lower part 324. In this manner the sensor mount 340 exposes the sensors to the flowstream between the outside of the PLT and the inside of the wellbore 120. In accordance with one or more embodiments the PLT may have a plurality of instances of the sensor mount 340 distributed around the outside diameter of the PLT to expose the sensors to the flowstream throughout the 360° orientation of the PLT and the wellbore 120. Performing the logging of the flowstream may begin before, when, or soon after the PLT has achieved logging mode.

In FIG. 6C the third mode of operation is a cleaning mode with two cleaning functions. Cleaning mode may be activated as needed. For example, the cleaning mode may be activated on a regular and/or predetermined time interval such as a preventive maintenance schedule. In one or more embodiments, cleaning mode may be activated, for example, in the event that the PLT stops recording any measurements. The inability of the PLT to record data may be attributed to deposits of viscid or sticky material(s) on the sensors. In accordance with one or more embodiments the PLT may comprise two different cleaning modes. One or more of the cleaning modes may be attempted prior to pulling the tool from the wellbore to the surface for general cleaning and running the tool again.

The first of the two cleaning functions of the third mode of operation is chemical cleaning. Chemical cleaning may include filling the tool solvent tank 306 prior to running the PLT into the wellbore 120. Filling the tank may be included in a pre-operation procedure. Chemical cleaning may further comprise pumping the cleaning solution 512 such as a mutual solvent from the tool solvent tank 306 to dispense the cleaning solution 512 against the sensors.

The second of the two cleaning functions of the third mode of operation is mechanical cleaning. Mechanical cleaning may include installing the brush (e.g., the fiber bristles 510) into the sleeve inner surface 316 of the protective sleeve 314. Installing the brush may be included in a pre-operation procedure. Mechanical cleaning may further involve activating the body actuator 328 to move the logging tool upper part 322 up and away from the logging tool lower part 324 thereby shifting the sensors to the recessed position. Mechanical cleaning may also involve deploying the protective sleeve 314 over the sensors (e.g., closing the tool sleeve) to provide an axial brushing motion over the sensors. Mechanical cleaning may further include rotating the protective sleeve 314 to provide a rotational brushing motion over the sensors. The axial and the rotational brushing motion alone or in cooperation with fiber bristles 510 of the brushes inside the sleeve may clean all the sensors mechanically.

Figure 7:
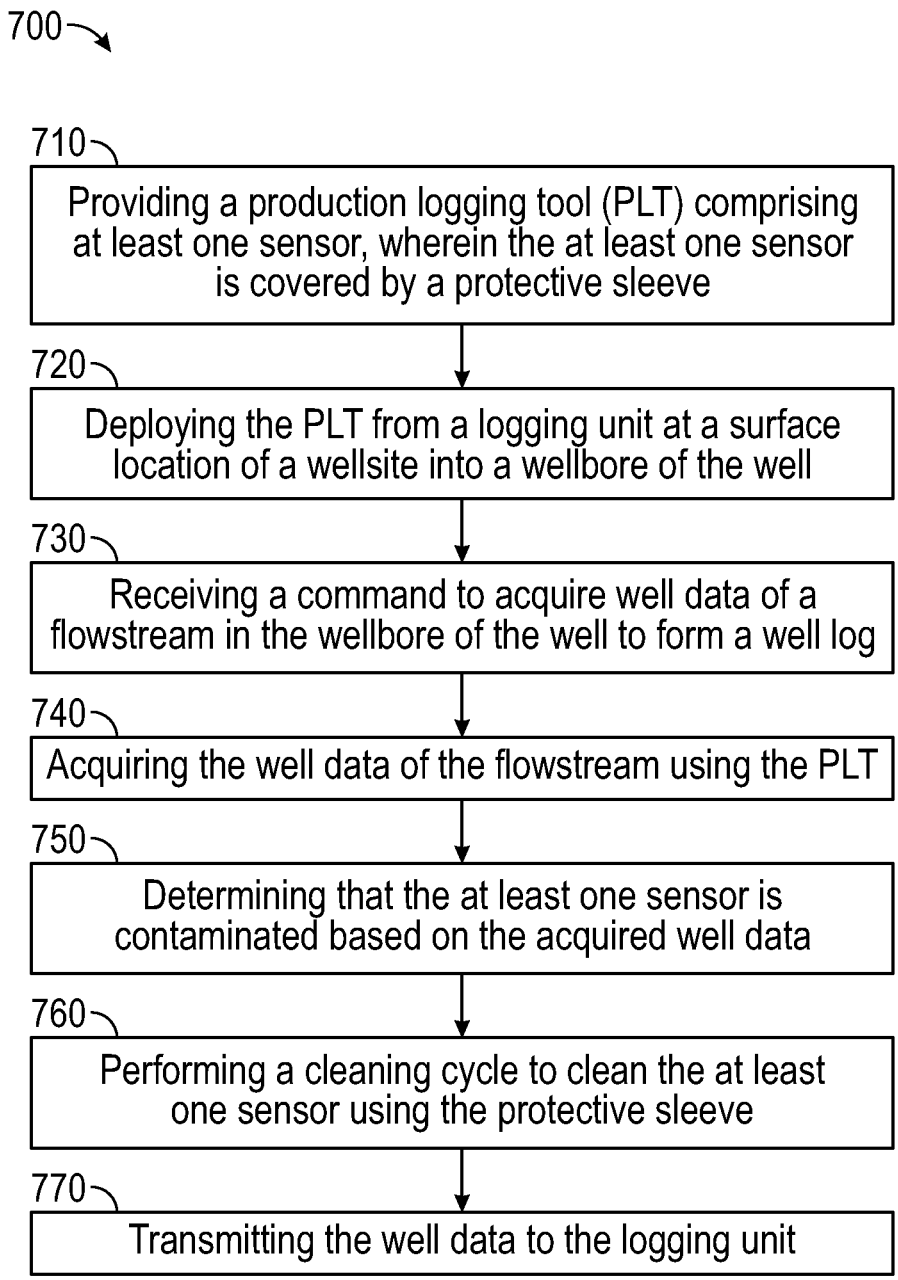
FIG. 7 shows a flowchart in accordance with one or more embodiments.

Turning to FIG. 7, FIG. 7 shows a flowchart in accordance with one or more embodiments. Specifically, FIG. 7 describes a general method (e.g., a method 700) to reduce the probability of having malfunctions from sensors coupled to instruments such as a production logging tool (PLT) that is deployed in a flowstream of a wellbore of a well. One or more blocks in FIG. 7 may be performed by one or more components (e.g., system 300 and/or PLT 302) as described in FIGS. 1, 2, 3, 4A, 4B, 5A, 5B, 6A, 6B, and 6C. While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

At step 710, initially a production logging tool (PLT) comprising at least one sensor and a protective sleeve is provided in a wellsite.

At step 720, the PLT is deployed from a logging unit at a surface location of the wellsite into a wellbore of the well.

At step 730, the PLT receives a command to acquire well data of a flowstream in the wellbore of the well to form a well log. The protective sleeve is retracted to uncover the sensors. The sensors thereby engage the flowstream.

At step 740, the PLT acquires the well data of the flowstream. This may be done using the sensors on the exterior of the PLT as described above. The sensors measure various well data of the flowstream while the PLT is operational in the wellbore.

At step 750, a user and/or the system may determine that the at least one sensor is contaminated based on the acquired well data. For example, contamination such as viscid deposits on the sensors may be suspected in the event that the PLT stops recording any measurements. The PLT may receive a command to perform the cleaning cycle. The logging unit may send the command. Furthermore, the method involves monitoring the well data received from the sensors. The well data may be compared to a preselected well data range. A computer processor may perform the comparing and determine a result of the comparing. The computer processor may then perform an action in response to the result of the comparing. Examples of actions include reporting an alert to a user device and/or controlling the PLT. Controlling the PLT may include sending a cleaning command to the PLT to perform the cleaning cycle.

At step 760, the system may perform a cleaning cycle to clean the at least one sensor using the protective sleeve. The tool solvent tank 306 and the protective sleeve 314 may be used to perform one or both cleaning modes. The system may apply the cleaning solution 512 from the tool solvent tank 306 to perform a chemical cleaning cycle. The system may activate the protective sleeve 314 to engage the cleaning mode. The fiber bristles 510 disposed on the sleeve inner surface 316 may brush against the sensors to perform a mechanical cleaning cycle. The system may perform the chemical cleaning cycle and the mechanical cleaning cycle in any order, concurrently, and/or repeatedly to clean the sensors.

At step 770, following the cleaning cycle the system may recommence transmitting the well data to the logging unit 150. Transmitting the well data may include having a command sent from the logging unit and receiving the command to acquire the well data of the flowstream thereby forming a well log.

Embodiments may be implemented on a computer system. FIG. 7 is a Block diagram of a computer 802 used to provide computational functionalities associated with described algorithms, methods, functions, processes, flows, and procedures as described in the instant disclosure, according to an implementation. Computer 802 is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 802 may include a computer that includes an input device, such as a keypad, keyboard, touch screen, or other device that can accept user information, and an output device that conveys information associated with the operation of the computer 802, including digital data, visual, or audio information (or a combination of information), or a graphical user interface (GUI.)

The computer 802 can serve in a role as a client, a network component, a server, a database or other persistency, or any other component (or a combination of roles) of a computer for performing the subject matter described in the instant disclosure. The computer 802 is communicably coupled with a network 816. In some implementations, one or more components of the computer 802 may be configured to operate within environments, including cloud-computing-based, local, global, or other environment (or a combination of environments).

At a high level, the computer 802 is an electronic computing device operable to receive, transmit, process, store, or manage data and information associated with the described subject matter. According to some implementations, the computer 802 may also include or be communicably coupled with an application server, e-mail server, web server, caching server, streaming data server, business intelligence (BI) server, or other server (or a combination of servers).

The computer 802 can receive requests over network 816 from a client application (for example, executing on another computer 802) and responding to the received requests by processing the said requests in an appropriate software application. In addition, requests may also be sent to the computer 802 from internal users (for example, from a command console or by other appropriate access method), external or third-parties, other automated applications, as well as any other appropriate entities, individuals, systems, or computers.

Each of the components of the computer 802 can communicate using a system bus 804. In some implementations, any or all of the components of the computer 802, both hardware or software (or a combination of hardware and software), may interface with each other or the interface 806 (or a combination of both) over the system bus 804 using an application programming interface (API 812) or a service layer 814 (or a combination of the API 812 and service layer 814. The API 812 may include specifications for routines, data structures, and object classes. The API 812 may be either computer-language independent or dependent and refer to a complete interface, a single function, or even a set of APIs. The service layer 814 provides software services to the computer 802 or other components (whether or not illustrated) that are communicably coupled to the computer 802.

The functionality of the computer 802 may be accessible for all service consumers using this service layer. Software services, such as those provided by the service layer 814, provide reusable, defined business functionalities through a defined interface. For example, the interface may be software written in JAVA, C++, or other suitable language providing data in extensible markup language (XML) format or another suitable format. While illustrated as an integrated component of the computer 802, alternative implementations may illustrate the API 812 or the service layer 814 as stand-alone components in relation to other components of the computer 802 or other components (whether or not illustrated) that are communicably coupled to the computer 802. Moreover, any or all parts of the API 812 or the service layer 814 may be implemented as child or sub-modules of another software module, enterprise application, or hardware module without departing from the scope of this disclosure.

The computer 802 includes an interface 806. Although illustrated as a single one of the interface 806, more than one of the interface 806 may be used according to particular desires or implementations of the computer 802. The interface 806 is used by the computer 802 for communicating with other systems in a distributed environment that are connected to the network 816. Generally, the interface 806 includes logic encoded in software or hardware (or a combination of software and hardware) and operable to communicate with the network 816. More specifically, the interface 806 may include software supporting one or more communication protocols associated with communications such that the network 816 or interface's hardware is operable to communicate physical signals within and outside of the computer 802.

The computer 802 includes at least one of a computer processor 818. Although illustrated as a single one of the computer processor 818, two or more processors may be used according to particular desires or particular implementations of the computer 802. Generally, the computer processor 818 executes instructions and manipulates data to perform the operations of the computer 802 and any algorithms, methods, functions, processes, flows, and procedures as described in the instant disclosure.

The computer 802 also includes a memory 808 that holds data for the computer 802 or other components (or a combination of both) that can be connected to the network 816. For example, the memory 808 may include a database storing data and/or processing instructions consistent with this disclosure. Although illustrated as a single one of the memory 808, two or more memories may be used according to particular desires and/or implementations of the computer 802 and the described functionality. While memory 808 is illustrated as an integral component of the computer 802, in alternative implementations, memory 808 can be external to the computer 802.

The application 810 is an algorithmic software engine providing functionality according to particular desires and/or particular implementations of the computer 802, particularly with respect to functionality described in this disclosure. For example, application 810 can serve as one or more components, modules, applications, etc. Further, although illustrated as a single one of application 810, the application 810 may be implemented as more than one of the application 810 on the computer 802. In addition, although illustrated as integral to the computer 802, in alternative implementations, the application 810 can be external to the computer 802.

There may be any number of computers associated with, or external to, a computer system containing computer 802, each one of the computers communicating over network 816. Further, the term "client," "user," and other appropriate terminology may be used interchangeably as appropriate without departing from the scope of this disclosure. Moreover, this disclosure contemplates that many users may use one of the computer 802, or that one user may use more than one of the computer 802.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method for logging a well, comprising:

providing a production logging tool (PLT) comprising at least one sensor, wherein the at least one sensor is covered by a protective sleeve comprising a sleeve inner surface configured to cover the at least one sensor;

deploying the PLT from a logging unit at a surface location of a wellsite into a wellbore of the well;

receiving a command to acquire well data of a flowstream in the wellbore of the well to form a well log;

acquiring the well data of the flowstream using the PLT;

determining that the at least one sensor is contaminated based on the acquired well data;

performing a cleaning cycle to clean the at least one sensor using the protective sleeve; and transmitting the well data to the logging unit.

2. The method of claim 1, wherein receiving the command further comprises sending the command from the logging unit.

3. The method of claim 1, wherein acquiring the well data further comprises retracting the protective sleeve to uncover the at least one sensor.

4. The method of claim 3, wherein acquiring the well data further comprises activating a moveable sensor mount coupled to the at least one sensor thereby exposing the at least one sensor to the flowstream.

5. The method of claim 1, wherein determining that the at least one sensor is contaminated based on the acquired well data further comprises:

monitoring the well data received from the at least one sensor;

comparing, using a computer processor, the well data to a preselected well data range; and performing, using the computer processor, an action in response to the comparing.

6. The method of claim 5, wherein performing the action comprises controlling the PLT.

7. The method of claim 6, wherein controlling the PLT comprises reporting an alert to a user device.

8. The method of claim 6, wherein controlling the PLT comprises sending a cleaning command to the PLT for performing the cleaning cycle.

9. The method of claim 1, wherein:

performing the cleaning cycle comprises performing a chemical cleaning cycle comprising:

distributing a cleaning solution around the sleeve inner surface; and dispensing the cleaning solution onto the at least one sensor.

10. The method of claim 9, wherein dispensing the cleaning solution further comprises:

filling, at the surface location, the cleaning solution into a cleaning reservoir through a reservoir inlet.

11. The method of claim 1, wherein performing the cleaning cycle comprises performing a mechanical cleaning cycle.

12. The method of claim 11, wherein:

the PLT further comprises:

a mechanical cleaner disposed on the sleeve inner surface and comprising a set of fiber bristles configured to contact the at least one sensor; and performing the mechanical cleaning cycle comprises:

actuating, using a sleeve actuator, the protective sleeve to clean the at least one sensor.

13. A system for logging a well comprising a wellbore, the system comprising:

a logging unit at a surface location of a wellsite;

a production logging tool comprising an upper part comprising a logging tool axis and a lower part disposed on the logging tool axis;

a body actuator coupled to the production logging tool upper part and the production logging tool lower part and configured to translate the production logging tool upper part and the production logging tool lower part along the logging tool axis;

at least one moveable sensor mount coupled at a strip first end to the production logging tool upper part, and coupled at a strip second end to the production logging tool lower part;

at least one sensor disposed on the at least one moveable sensor mount and configured to acquire well data of a flowstream in the wellbore of the well to form a well log; and a protective sleeve comprising a sleeve inner surface configured to cover the at least one sensor.

14. The system of claim 13, wherein the at least one sensor comprises:

at least one spinner disposed on the at least one moveable sensor mount and configured to obtain flowrate data of the well data.

15. The system of claim 13, wherein the at least one sensor comprises:

at least one optical sensor disposed on the at least one moveable sensor mount and configured to distinguish a gas phase and a liquid phase of the well data.

16. The system of claim 13, wherein the at least one sensor comprises:

at least one resistivity sensor to distinguish between an oil phase and a water phase.

17. The system of claim 13 wherein:

the protective sleeve is disposed on the logging tool axis and coupled, using an internal connection mechanism, to a sleeve actuator, the protective sleeve is configured to move, using the sleeve actuator and the internal connection mechanism, axially along the logging tool axis, and the protective sleeve is configured to rotate, using the sleeve actuator and the internal connection mechanism, rotationally about the logging tool axis.

18. The system of claim 13, wherein the protective sleeve further comprises:

a mechanical cleaner disposed on the sleeve inner surface and comprising a set of fiber bristles configured to contact the at least one sensor.

19. The system of claim 18, wherein the protective sleeve moves the set of fiber bristles, in contact with the at least one sensor, rotationally about the logging tool axis.

20. The system of claim 13, further comprising:

a cleaning reservoir, disposed within the system, comprising a reservoir inlet and a reservoir outlet, configured to hold a cleaning solution filled through the reservoir inlet; and a manifold in hydraulic communication with the reservoir outlet and a pump inlet of a pump and comprising at least one valve for controlling a cleaning flow of the cleaning solution, wherein the pump is configured to draw, using the manifold and the at least one valve, the cleaning solution from the reservoir outlet and to direct the cleaning solution from a pump outlet of the pump onto the at least one sensor.

* * * * *